United States Patent [19]

Langen

[11] Patent Number: 4,735,031

[45] Date of Patent: Apr. 5, 1988

[54] APPARATUS FOR PACKING AND PROCESSING A MEAT PRODUCT

[75] Inventor: Christianus P. Langen, Cuyk, Netherlands

[73] Assignee: Langen Research B.V., Cuijk, Netherlands

[21] Appl. No.: 906,893

[22] Filed: Sep. 12, 1986

[51] Int. Cl.[4] ..... B65B 63/00

[52] U.S. Cl. ..... 53/122; 53/373; 493/101

[58] Field of Search ..... 53/122, 468, 282, 469, 53/384, 479, 373, 512, 432, 389, 434, 375; 493/100, 101

[56] References Cited

U.S. PATENT DOCUMENTS

| | | | |
|---|---|---|---|
| 2,380,913 | 8/1945 | Bennett | 493/101 |
| 3,849,969 | 11/1974 | Paules | 53/389 X |
| 4,019,305 | 4/1977 | McGhie et al. | 53/479 |
| 4,035,982 | 7/1977 | Paules | 53/434 X |
| 4,308,710 | 1/1982 | Sandberg | 53/512 X |
| 4,522,012 | 6/1985 | Nelson | 493/100 X |
| 4,545,177 | 10/1985 | Day | 53/512 X |

*Primary Examiner*—Robert L. Spruill
*Assistant Examiner*—Steven P. Weihrouch
*Attorney, Agent, or Firm*—Fetherstonhaugh & Co.

[57] ABSTRACT

A method and apparatus for packing a meat product, such as ham, in foil, in which a mould is used to accommodate a bag-shaped foil. The apparatus includes a first support member for supporting the bag and the mould. A mechanism is also provided for turning-down the collar of the bag around the top edge of the mould. A second support is provided for supporting the mould containing the bag-shaped foil filled with meat product together with a second mechanism for turning-up the collar of the bag. A third support is provided for supporting the mould with the filled bag-shaped foil, and a sealing appliance is provided for sealing the collar.

30 Claims, 10 Drawing Sheets

FIG. 2
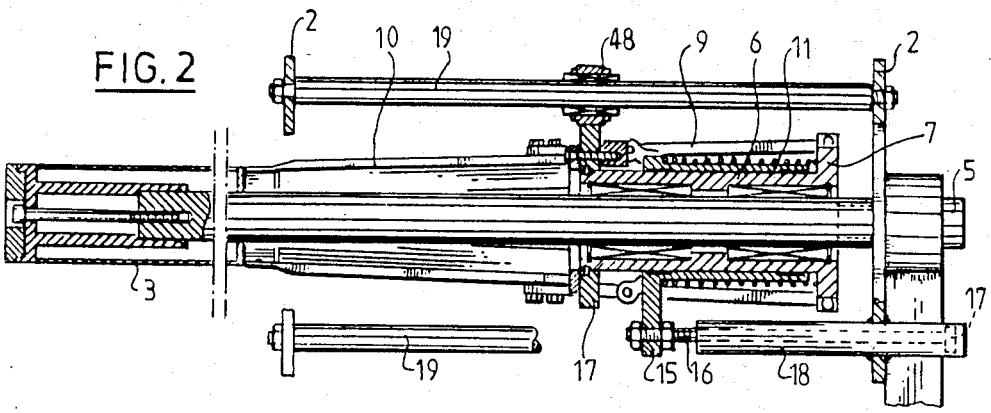
FIG. 3
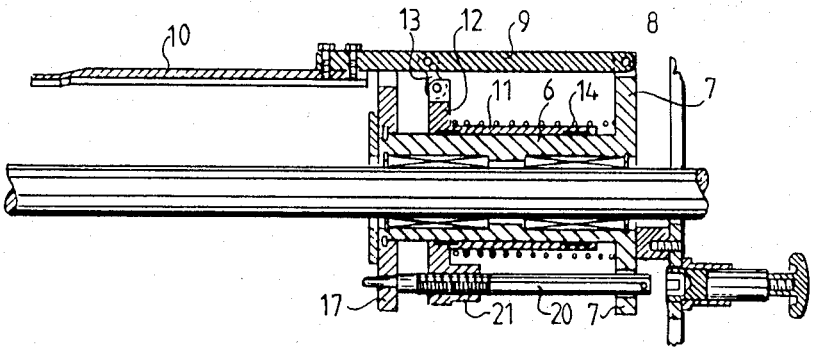
FIG. 4
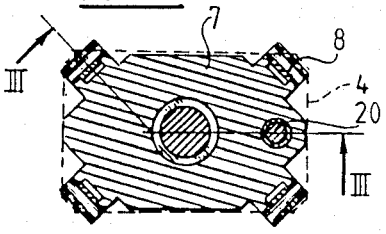
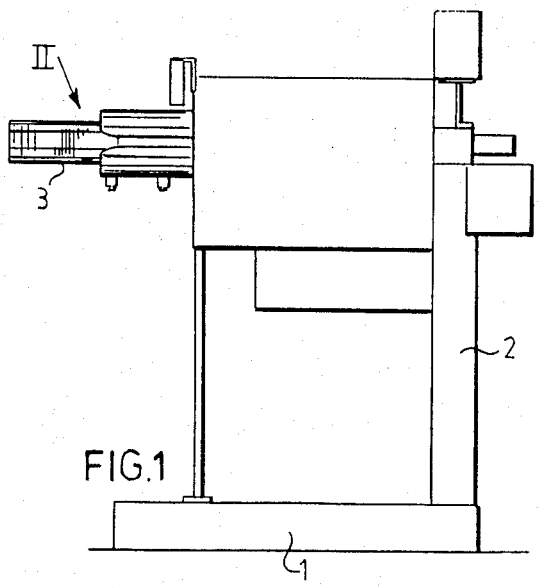
FIG.1

M
M
M
41
41'
4

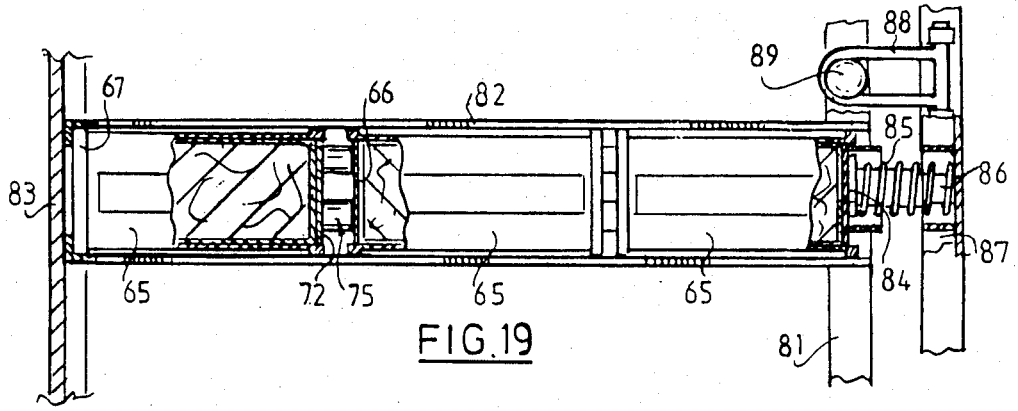
FIG. 19
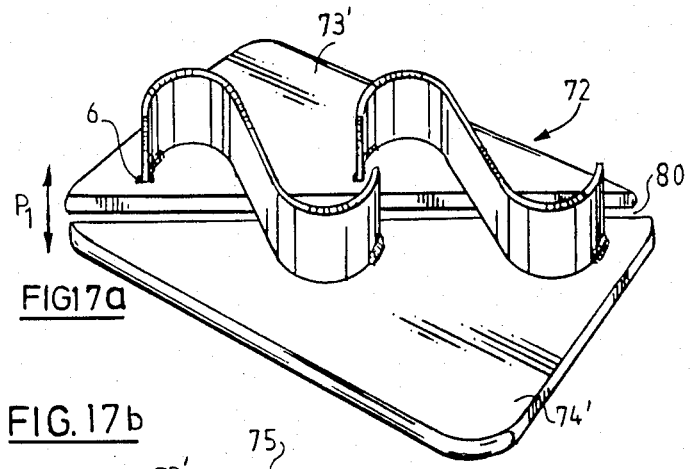
FIG17a
FIG. 17b
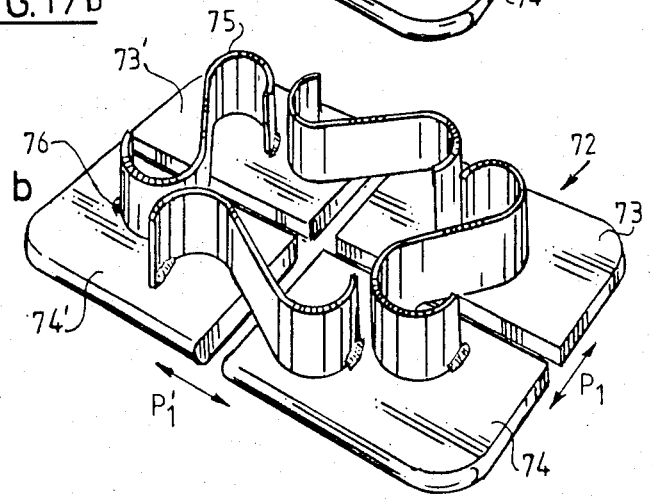

APPARATUS FOR PACKING AND PROCESSING A MEAT PRODUCT

The invention concerns an apparatus and method for packing and processing a meat product, such as ham, in foil, use being made of a mould for accommodating bag-shaped foil.

It is usual to pack pieces of meat, after pre-treatment, in a tin, and to process the meat further in the tin, for example by warming up or heating it to a particular temperature such a pasteurization temperature, by which process the meat achieves its final condition. The meat product in the tin is then ready for transport, storage sale and consumption.

The disadvantages of packing the meat in tins are the high cost, and the weight, involved. The weight, in particular, is disadvantageous during transport and storage.

In a mould of this kind a number of pieces of meat are deposited, after which the meat is cooked in the mould in order to obtain the desired product like ham. The mould serves here as a support for obtaining the correct shape.

The invention aims to provide an apparatus by use of which the mould can be lined with foil and filled with pieces of meat, and the bag-shaped foil can be sealed airtight; and this in such a way that the foil remains free of fat or meat particles at the places where the seal is made, in order to realize an absolutely airtight seal.

The apparatus according to the invention is distinguished by:

a first support member for supporting the bag and the mould, and a first means, displaceable relative to the support member, for turning down the collar of the bag around the upper edge of the mould;

a second support member for supporting the mould containing the bag filled with the meat product, and a second means, displaceable relative to the second support member, for returning the collar of the bag up to its stating position;

a third support member for supporting the mould with filled bag-shaped foil, the third member being provided with a sealing appliance for the sealing of the collar.

In order to let the turning-down and returning of the collar of the packing foil occur without the formation of creases, it is preferable to form the means for turning-down and/or returning the collar by two or more blades displaceable along the outer wall of the mould.

The turning-down blades are hereby preferably supported pivotably on an axis transverse to the displacement direction, in order first to stretch the collar before turning it down.

The returning blades are preferably formed as hooks, the hook length corresponding at least to the height of the collar of the bag-shaped foil. The aim of this latter feature is to grasp the collar approximately at the position of the edge of the mould, so that the turning-down or returning begins immediately at the edge of the mould.

To provide a large packaging capacity, the second support member is made in the form of a turntable which is mounted in a conveyor track, the returning blades being set up in groups around the turntable.

If the mould used is polygonal, there are, according to the invention, as many turning-down (and returning) blades needed as there are corners. By preference, the turning-down and returning means are so arranged that they act at the corners of the mould which is placed in the apparatus, an arrangement which, in trials, caused the least puckering of the collar.

According to the invention, the third support member is formed as a vacuum chamber which can be closed with a door, and in which the sealing means are incorporated. These latter are preferably formed as a horizontally extensive table at the height of the collar, and a reciprocably moveable pressing punch, a folding member being fitted in the vacuum chamber for holding the collar flat over the horizontal table.

The invention further concerns a mould for use in the above described method, the mould being distinguished in having a cylindrical mould-section with a closed bottom and an open side, opposite that bottom, and also a cover-section whose outer circumference abuts with a close fit against the inner surface of the mould-section. Owing to the cylindrical shape, the cover-section can slide along the inner surface, whereby the pressurization of the lining can easily take place by the exertion of pressure on the cover-section. Since the meat tends to expand during the heating phase, any clearance between the cover-section and the mould-section has to be prevented, in order to give the final meat product its required shape, without protusions.

To improve the close fit of the cover-section, this is divided into two or more mutually displaceable members, so that any clearance can be taken up by movement of the cover members.

In a preferred embodiment, the cover members are mutually connected by curved spring strips which stand perpendicularly on the cover members. When the cover is inserted in the mould, the cover members can be pressed close to one another against the spring pressure so that after insertion the springs ensure a constant pressure of the cover members against the inside of the mould.

A preferred embodiment of the mould-section is one in which it has a rectangular shape in cross-section, the side walls being provided with one or more reinforcement ridges. This results in a block-shaped meat product, the ridges increasing the stability of shape of the mould-section.

To the same end of stability of shape, the edge strip of the mould-section can also, or instead, be reinforced by a thickening of the wall of the mould.

The invention further concerns a bag-shaped lining which is suitable for an above-described mould, the lining being distinguished in that its longitudinal dimension is greater than that of the mould, and the inner circumference of the extended collar-shaped part of the lining is greater than that of the bag-portion which fits into the mould-section. By this means, the bag-shaped lining can, before it is filled with meat products, be turned down over the edge strip at the open end of the mould section, whereby the turned down portion of the lining remains free of any contamination due to spillage, which is an advantage during the subsequent airtight sealing of the lining.

The enlargement of the inner circumference of the extended part can easily take place of the bag-shaped lining is folded from soil, the edges to be joined being impermeably welded, and the longitudinal welded seam of the bag-shaped portion being wider than that of the extended portion.

The invention further concerns a holder for accommodating moulds during the penultimate step of the above-described method. This step involves the heating and pressurizing of the contents of the mould.

The holder according to the invention is distinguished by at least one guide for the adjacent accommodation of more than two moulds, such that the cover-section of one mould lies against the bottom of the adjacent mould, the guide being made with a fixed end partition at one extremity and an elastically compliant end partition at the other. In this way, two or more moulds can be simultaneously placed under longitudinal pressure, since the bottom part of one presses against the slidable cover section of the next adjacent mould, thus pressurizing its contents. The entire holder can be placed in a heating appliance, for example an autoclave or a steamer.

Finally the method according to the invention is distinguished by the following steps:

filling a mould, which is prepared with an impermeable releasable lining, with the meat pieces;

evacuation and airtight sealing of the lining;

heating the meat for a predetermined length of time, whilst simultaneously exerting pressure on the closed lining in the mould;

taking the meat product, ready and packed in the airtight lining, out of the mould.

In trials, it has appeared that the meat product, ready and packed in the lining, takes on exactly the shape of the mould, without any externally visible air inclusions etc. This improves the aesthetic appearance of the meat product, with the consequence that transparent linings, for example of plastic, can be used. This latter is preferable, because the purchaser can immediately percieve the quality of the meat.

The invention will be further explained in the description of the drawings, below.

In the drawings:

FIG. 1 shows a side view of a part of the apparatus provided with the first support member, FIG. 2 shows a standing longitudinal section of part of the apparatus of FIG. 1, indicated by arrow II;

FIG. 3 shows a section corresponding to FIG. 2 of that part of the apparatus according to the line III—III in FIG. 4, however with a differEnt position of the turning-down means;

FIG. 4 shows an upright transverse section of the apparatus of FIG. 2;

Figure 6:
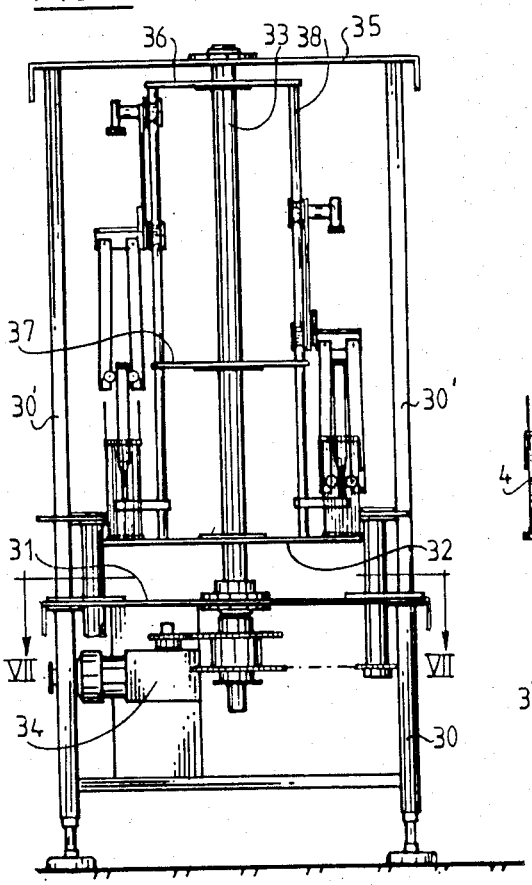
Figure 7:
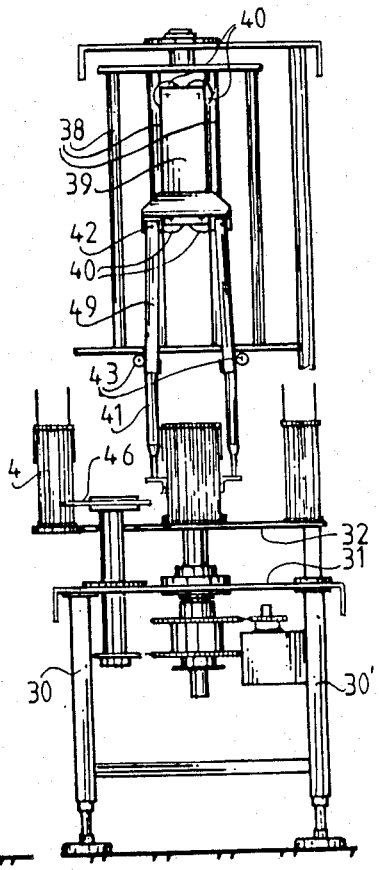
Figure 8:
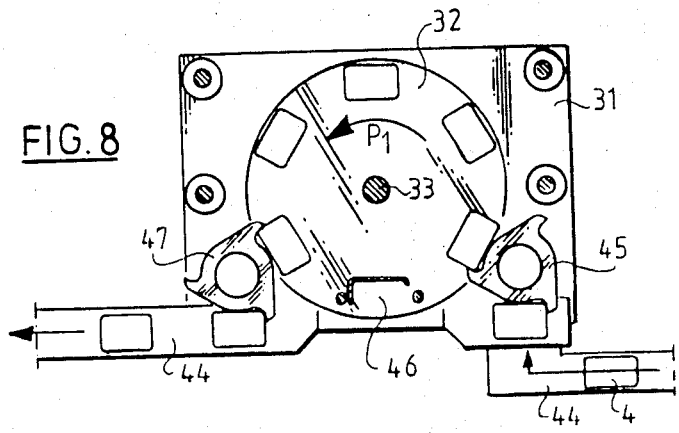
Figure 10:
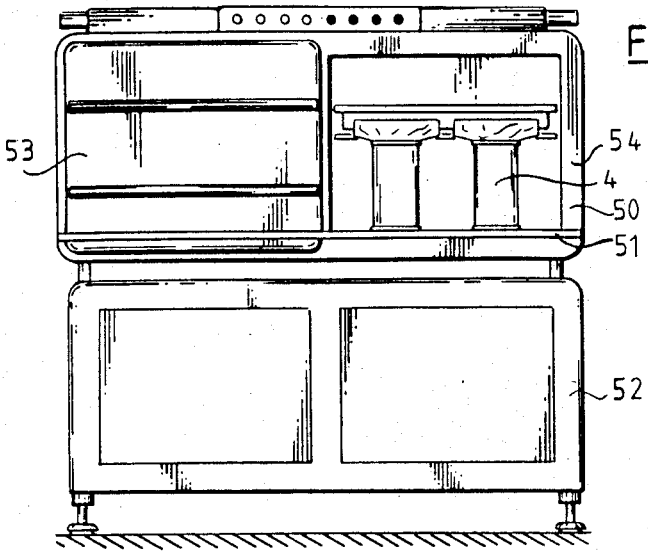
Figure 11:
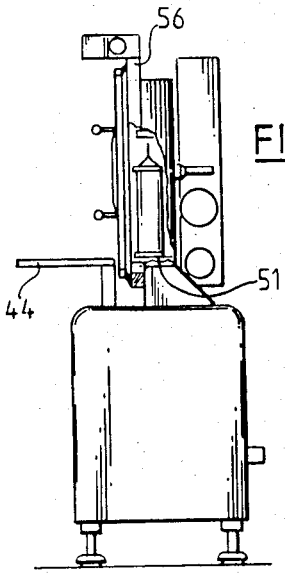
Figure 12:
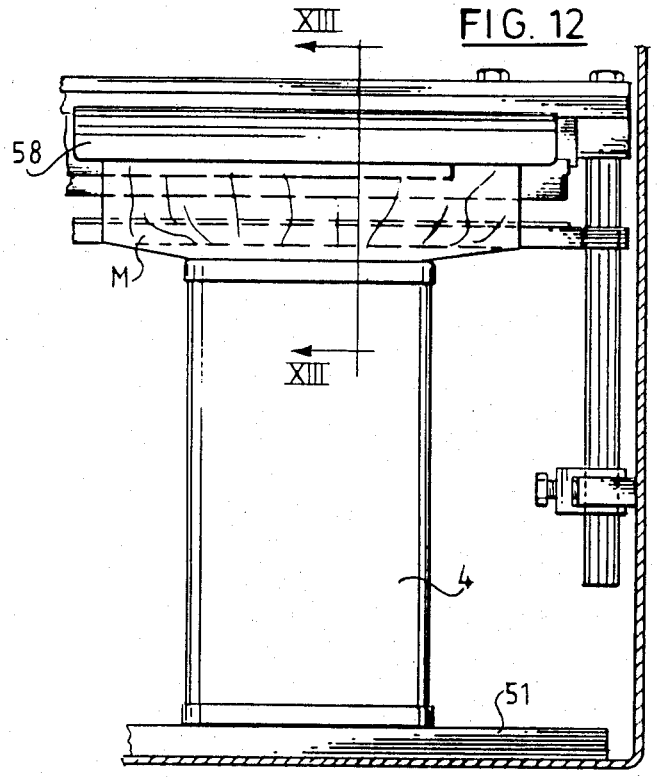
Figure 13:
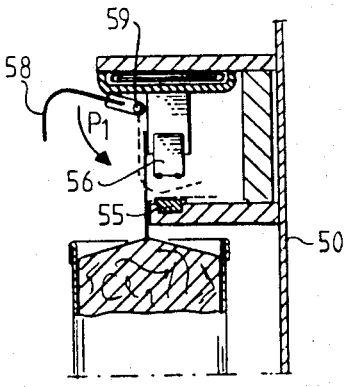
Figure 14:
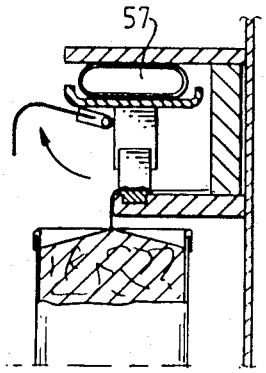

FIGS. 5*a* to 5*e* inclusive show a side view of the apparatus of FIG. 2 in various stages of usage;

FIGS. 6 and 7 show upright front and side views, respectively, of part of the apparatus, provided with the second support member in the form of a turntable;

FIG. 8 shows a top view of the apparatus of FIG. 6;

FIGS. 9*a* to 9*e* inclusive show the returning means applied in the apparatus according to FIG. 6, in various stages of usage;

FIGS. 10 and 11 show a front and side-elevation respectively of a part of the apparatus provided with the third support member, made as a vacuum chest;

FIG. 12 shows, on an enlarged scale, a view of the apparatus corresponding to FIG. 10;

FIGS. 13 and 14 show a standing section according to line XIII—XIII in FIG. 12 through the sealing means, in two respective positions thereof.

Figure 15A:
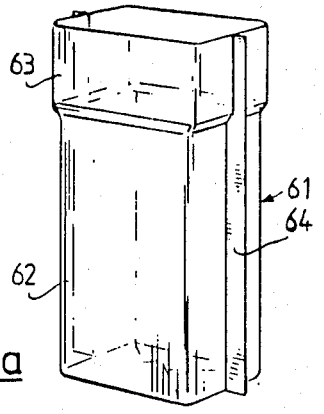
Figure 15D:
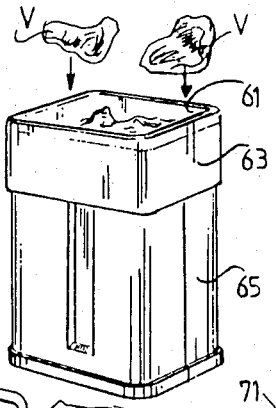
Figure 15E:
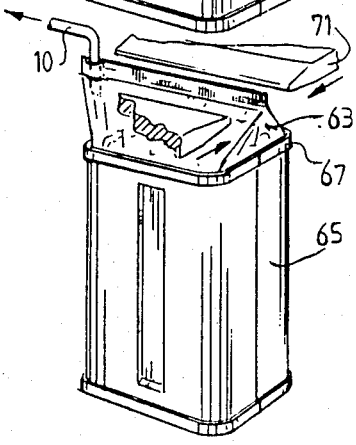
Figure 15B:
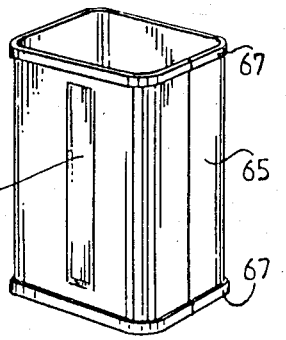
Figure 15C:
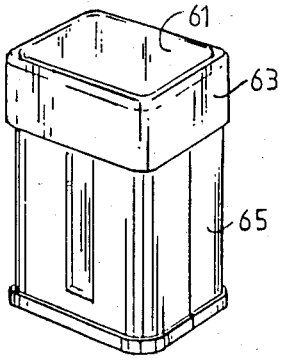
Figure 15F:
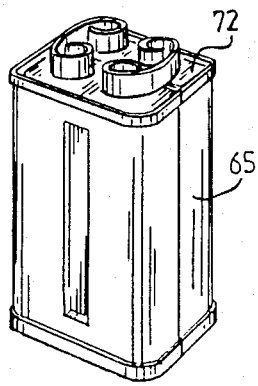
Figure 16:
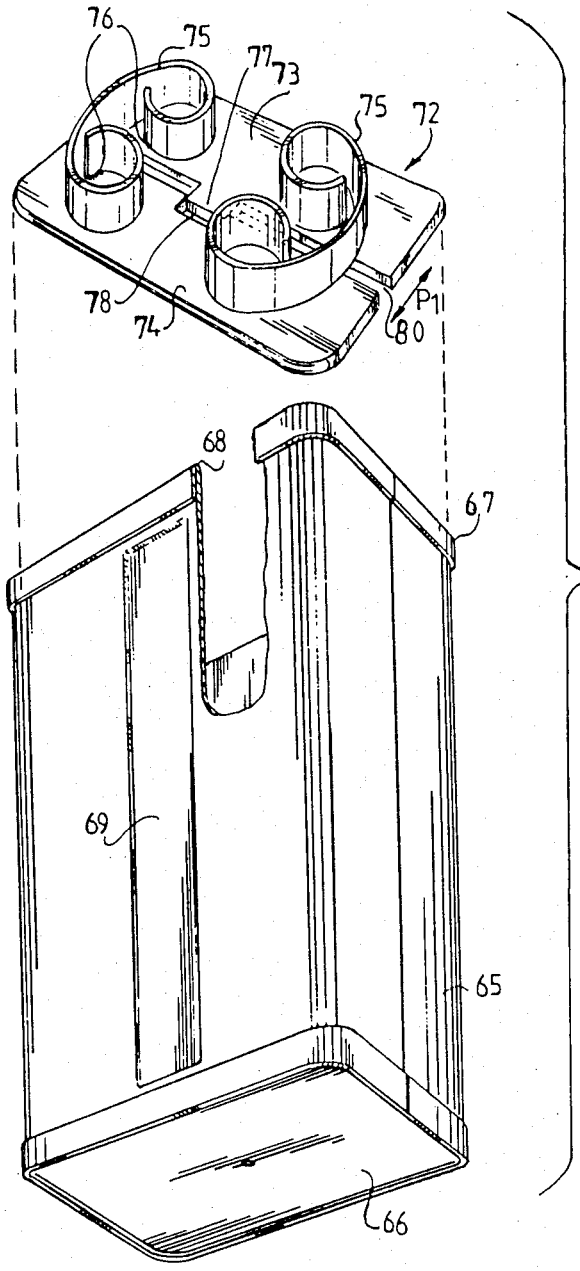
Figure 18:
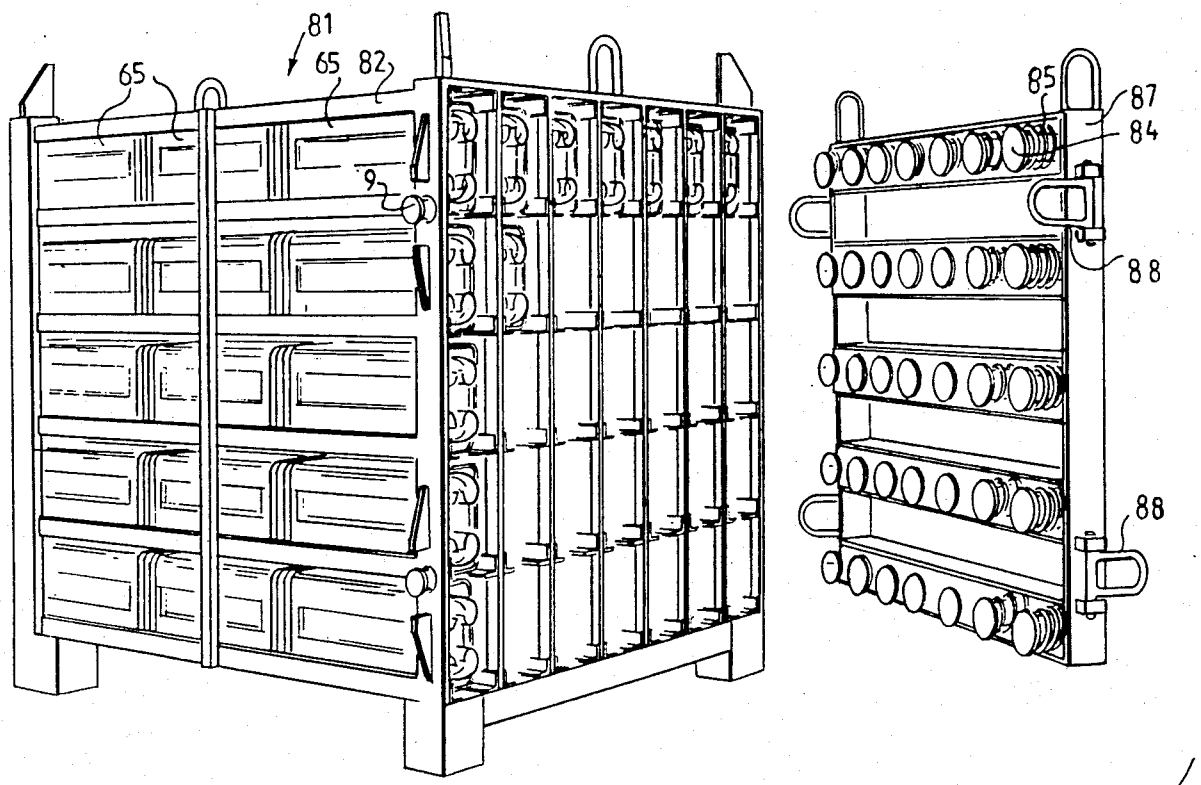

FIGS. 15*a* to 15*f* inclusive show various phases of the method according to the invention;

FIG. 16 shows a perspective bottom view of a mould suitable for the method of FIG. 15, and also perspective top view of the cover-section which can be applied therein;

FIGS. 17*a* and 17*b* each show a perspective top view of one of two alternative embodiments of cover-sections;

FIG. 18 shows a perspective side view of a holder for moulds from FIG. 16;

FIG. 19 shows a side view of part of the holder from FIG. 18.

FIG. 1 shows the first part of the apparatus, which consists of a base 1 upon which a frame 2 is mounted, in which box-shaped frame the support member 3 is placed, the support member partially projecting out of the frame 2. The support organ 3 serves for accommodation of a bag-shaped foil, and subsequently for a mould which is pushed thereover. The cross-section of the left-hand part of the support member 3 therefore corresponds to that of the mould to be placed upon it, here understood as a rectangular mould 4, which is indicated by dashed line 4 in FIG. 4. The mould is described in detail here below.

The support member 3 is further embodied with a central spindle 5, which is fastened in the frame 2. Around spindle 5 there is mounted a slidable carriage 6, which is provided at one end with a standing flange 7 of rectangular shape (see FIG. 4). Flange 7 is made with a hinge pin 8 at each corner, about which an elongate arm 9 can be swivelled. Arm 9 is extended at the end remote from the hinge pin 8 by a blade 10, whose function will be further explained below.

On the outside of carriage 6 a sleeve 11 is fitted, the sleeve also being provided with a radially outward projecting flange 12, in which a hinge arm 13 is pivotably journalled. The other end of hinge arm 13 is rotatably attached to arm 9.

Between flange 12 and flange 7 to slide 6, a compression spring 14 is fitted.

Flange 12 is at one side also provided with a protecting arm 15, to which there is fastened the rod 16 of a piston 17 in a cylinder 18. The cylinder 18 is fixed to the frame 2.

Slide 6 is provided, opposite flange 7, with a second flange 17 mounted thereon, flange 17 being made with plain bearings 48 which are slidable along slide rods 19, which are mounted in frame 2 parallel to spindle 5.

Between flange 17 and flange 7 there is a dowel 20 fitted, along which a bush 21 of flange 12 is slidable, for the purpose of guiding the sleeve 11.

The length of arm 9 with the blade 10 is such that in the position according to FIG. 2, the free end of the blade 10 rests against the inward facing end surface of support member 3 (see FIG. 2). The extremity of the blade is bent inwards to a small extent, in order to ensure a smooth passage of the foil thereover.

The operation of the apparatus according to FIGS. 1 to 4 inclusive is explained with reference to FIGS. 5*a* to 5*e* inclusive.

A foil F, which is made with an already attached collar M, is slid over support member 3. The length of foil F and collar M is such that this collar can be entirely slid over the blades 10 (see FIG. 5*b*).

The mould 4 is then fitted over the foil F (see FIG. 5*c*), whereby sensing members 21 and 22 detect the presence and the final position, respectively, of mould 4, and subsequently energize cylinder 18. On actuation of cylinder 18, arm 15 of sleeve 11 is first slid leftwards in FIGS. 2 and 3, whereby hinge arms 13 press blades 10 outwards, because slide 6 initially remains stationary.

Figure 5A:
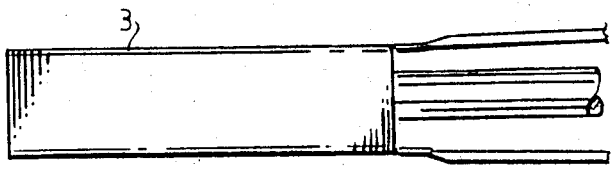
Figure 5B:
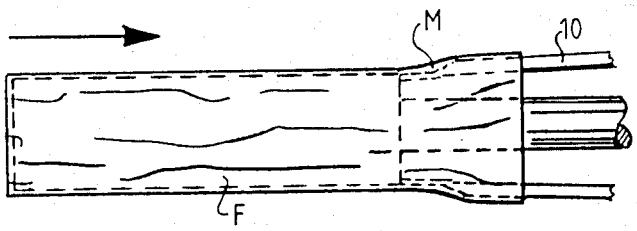
Figure 5C:
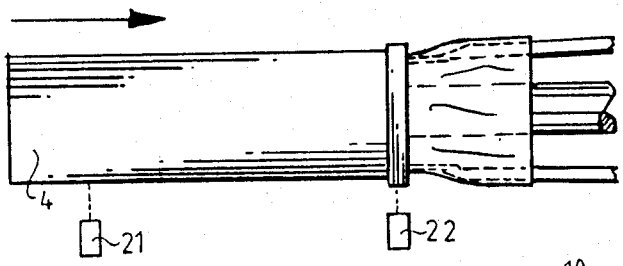
Figure 5D:
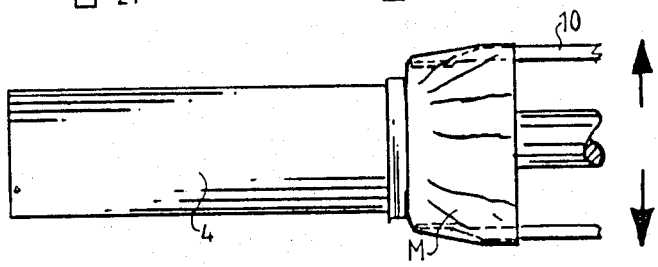

As soon as flange 12 strikes flange 7, further pushing of piston rod 16 out of cylinder 18 results in slide 6 also moving to the left. The outward directed movement of blades 10 is shown in FIG. 5*d*. On further leftward movement of blades 10, which are fastened to slide 6, collar M is folded precisely over the edge of mould 4, without occurrence of puckering. This is effectuated by the above described widening of the collar M close to the end edge of mould 4, before beginning folding over of the collar.

Figure 5E:
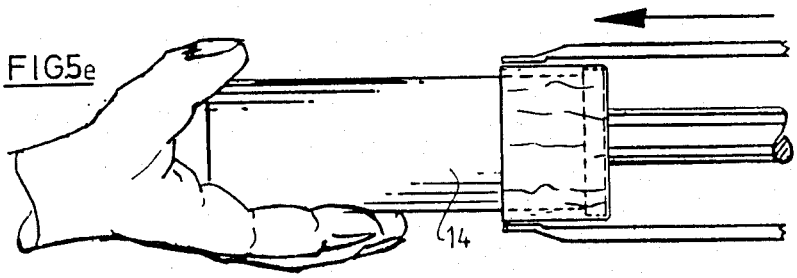

The mould 4 with the turned-down collar can then be taken off support member 3 and brought to a filling station, which operation is indicated schematically by the hand in FIG. 5*e*. Obviously, this operation can be carried out entirely mechanically. The filling of the mould with the foil fitted therein and the folded-down collar falls outside the scope of the present invention, and is not further shown. Every suitable filling machine can be used for this, and it will be clear to the reader that the mould can easily be mechanically filled with pieces of meat without soiling the folded-down collar.

The filled mould is then brought to a second support member of the apparatus, which is here embodied as a table which is rotatable around a vertical spindle, shown in FIGS. 5 to 9 inclusive.

In the drawings numeral 30 indicates the frame, which consists of four columns, joined at their top ends by a rectangular table 31 (see FIG. 8). In this rectangular table there is mounted a turntable 32, which is journalled on a vertical spindle 33. The driving of table 32 is carried out by a motor and transmission unit 34 mounted in the frame 30. The driving unit can be made in any arbitrary way and therefore needs no further description.

The two rear columns 30' are extended above table 31, and at their upper ends a connecting plate is fitted for accommodating the upper end of spindle 33. Around the top part of spindle 33 there are two supporting plates 36 and 37 fitted, one at a distance above the other, between which pairs of guiding bars 38 are mounted. Between the guiding bars there is a carriage 39, with wheels 40, rollable in a vertical direction, at each of its four corners. The carriage bears on its underside arms 49, each of which is extended by a blade 41, which can reach almost to the turntable 32. The arms are suspended pivotably at 42 from the underside of carriage 39, and during upward or downward vertical movement are led guide rollers 43. The arrangement is such that, on descending movement, the blades 41 spread away from one another, so that the lower ends amply clear the upper edge of a mould 4 which is situated on turntable 32, and come to rest against the outer wall of mould 4 at some distance beneath the upper edge thereof. On an ascending movement, the blade 41 remain in contact with the outer wall of mould 4, and come into place under the folded-down collar of the foil.

The rising and descending movement of carriage 39 along guide bars 38 can also take place in any arbitrary way, and is not further described.

The turntable 32 forms part of a conveyor track 44, upon which the filled moulds are delivered from the right in FIG. 8, and are brought into a place 46 on the turntable by a rotating transport mechanism 45, and, after the moulds have passed through the five stations of turntable 32 illustrated in FIG. 8, in the direction of arrow P1, they are replaced on the conveyor track 44 by a rotating transport organ 47.

The position of blade 41 in relation to the mould 4 at each of the five stations are indicated in FIGS. 9*a* to 9*e* inclusive.

Figures 9A, 9B, 9C, 9D, 9E:
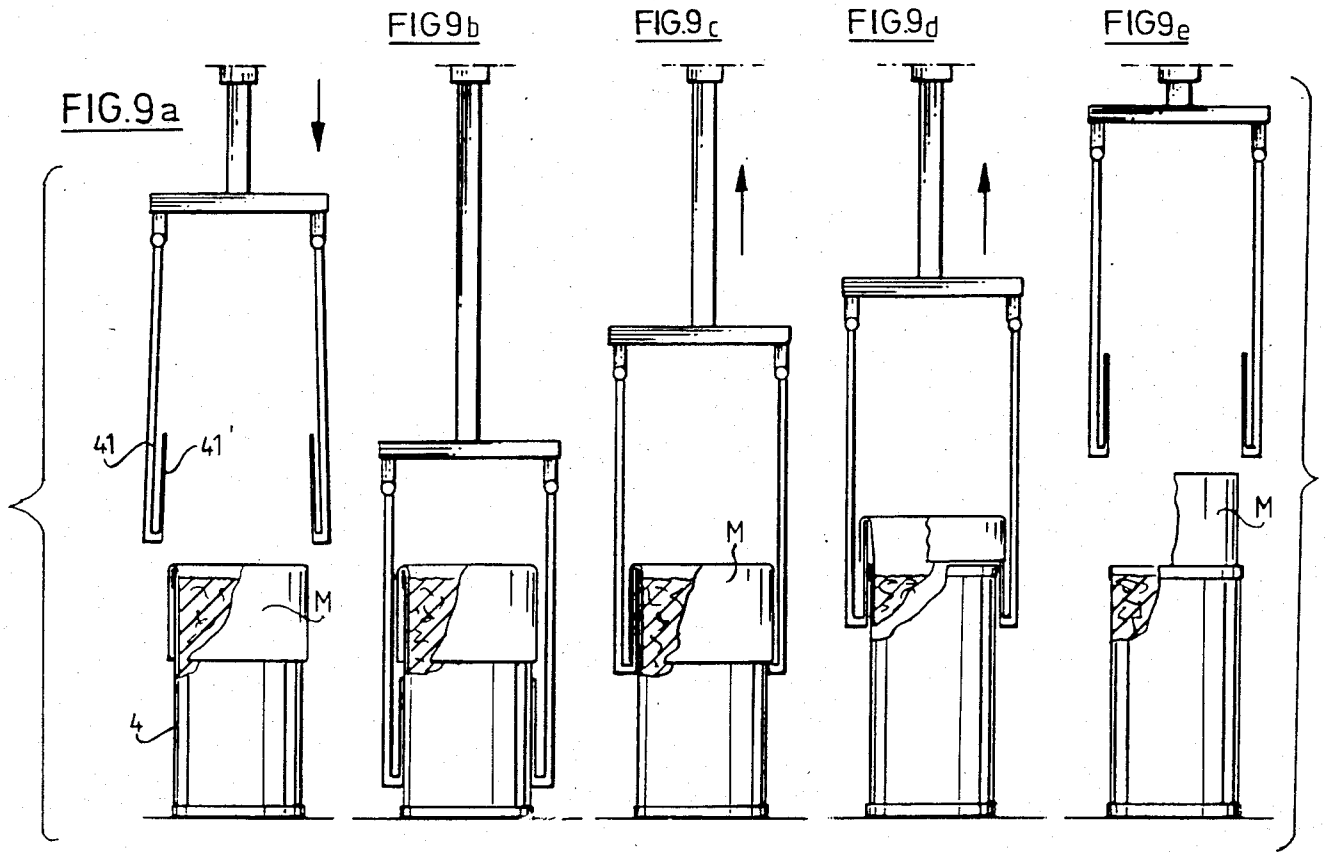

Thus, FIG. 9*a* shows the position in which the filled mould 4 with turned-down collar M is situated beneath the blade 41.

During descent of the blade 41, these move down with an ample margin past the upper edge of mould 4, after which they come to rest close to the bottom of the mould, in contact with its outer wall. During ascent, the hook-like lower ends of blade 41 pass under the turned-down collar M, (see FIG. 9*c*), after which, on further ascent of the levers 41, they pull the collar back into the position according to FIG. 9*e*.

It should be noted here that the length of the hook-like portion 41' is greater than the height of the turned-down collar M, so that the extremity of the hook travels in the top fold of the collar of the foil while the collar is being folded back up. Since the outside of the collar M, during filling, has remained free from fat and other contamination, its inner wall, after it has been folded up again, will equally have remained clean, which is important for the sealing phase which follows.

The sealing phase will be further explained by reference to FIGS. 10 to 14 inclusive.

Directly following conveyor belt 44 of FIG. 8, there is situated a third supporting organ in the form of a vacuum chest 50. The bottom 51 of the vacuum chest lies at the same level as the conveyor belt 44 (see FIG. 11), so that the insertion of a mould 4 can repeatedly take place without interruption. The vacuum chest consists of two adjacent sections, each of which can be separately evacuated. Both sections rest on top of a plinth 52, in which the pump for evacuation is situated. The sections can be closed airtight by a cover or door 53. To this end, door 53 is provided at its circumference with a flexible sealing strip, which creates a seal against the flat edge 54 of the vacuum section.

The door can be slid along a top rail 56 across the front faces of the vacuum sections, an action which can take place manually or mechanically.

In the vacuum chest there are situated sealing means (see FIGS. 12 to 14 inclusive), which consist of a horizontally extending table 55, which is securely joined to the rear side of the vacuum chest 50, and of which the height above the bottom 51 is such that it approximately at the level of collar M projecting above mould 4. Collar M is either manually or mechanically folded flat, so that the opposing parts come into contact with each other.

Above supporting table 55 there is situated a heatable pressing punch 56, which is fixed to the lower side of a flexible hose 57. Hose 57 is sealed airtight, and contains a medium under a definite pressure.

The pressing punch 56 is equipped on the side facing the front with a folding-member 58, which is joined with a hinged connection to the punch at 59. The folding-member consists of a bent plate whose breadth corresponds to that of collar M when folded flat (see FIG. 12). The folding member can be turned in the direction of arrow P1 to a position under the pressure punch 56, and back again.

The above described apparatus works as follows:

After mould 4 has been positioned and the collar M has been folded out flat (see FIG. 12), the folding-member can fold the collar over through an angle of 90° onto the supporting table 55, and smooth it out. Through this folding process, the collar M can no longer pucker, which helps during airtight sealing.

Then the operator can close the vacuum chest by applying the cover 53 in front of the appropriate section. Consequent to the evacuation of the section, tube 57 will, because of the pressure of the medium, automatically push pressing punch 56 in the direction of pressing table 55, and thus weld the two layers of the collar together. After the sealing operation, the air pressure in the section can be allowed to return, the mould can be taken out, and the contents of the evacuated foil can be processed further, for example by pasteurization or cooking.

In FIG. 15 number 61 indicates a bag-shaped lining, which consists of a lower portion 62 and an extended upper position 63 whereof the inner circumference is greater than that of the lower position 62, the reason for which will be explained below. This widening of the inner circumference can easily be brought about, starting with a foil material, such as transparent plastic, which is folded shut at the bottom in the usual way, and which is sealed along the side by means of a longitudinal seam, the inner circumference of the bag automatically becomes correspondingly wider.

FIG. 15*b* shows the mould according to the invention, which consists of a cylindrical portion 65, with a fixed bottom 66 (see also FIG. 16). It should hereby be noted that the cross-section of the cylindrical portion 65 has a principally rectangular shape. The lower and upper edges of cylindrical portion 65 are reinforced by thickenings 67, in the walls, which can be made by, before bending a cylinder from sheet material, first folding the edges over through 180° (see item 68 in FIG. 16). The wide side-wall of the cylindrical portion 67 is strengthened by a recessed portion forming a reinforcement rib 69. Hereby, potential bulging outwards of the side-wall of cylindrical part 65 during pressurization of the contents is avoided.

FIG. 15*c* shows the mould in which lining 61 is fitted, with the extended portion 63 being folded down over the upper edge 67, of the mould. This is possible owing to the larger inner dimensions of the extended portion 63.

FIG. 15*d* shows the situation in which the mould with the lining 61 fitted therein is filled with pieces of meat, V. After sufficient pieces of meat have been put into the mould, edge 63 is folded back again, and then firstly the lining is evacuated at the top by means of a vacuum apparatus 70 and, subsequently, it is sealed airtight by a welding apparatus 71. The projecting sealed part 63 of the lining is folded down in the usual way, for example in the same way as the bottom, after which cover-section 72 is placed in the open end of the mould, according to FIG. 15*f*.

Cover-section 72 consists, in the form shown according to FIG. 17, of two members 73 and 74, which are mutually connected by means of spring strips 75, standing perpendicularly thereon, for example by securing the ends of the curved spring strips by welding at 76. One of the members 73, is provided with a lip 77, which fits into a recess 78 of the other cover-member 74. In this construction, a sideways relative movement of members 73 and 74 in the direction of arrow P1 is permissible. In the position during assembly by welding, there is a narrow gap 80 between the members, such that on insertion in mould 65, the member 73 and 74 must be pressed towards one another against the prssure of spring leaves 75. As soon as cover-section 72 has been inserted in cylindrical mould-section 65, after releasing of the lid, spring strips 75 press cover-member 73 and 74 firmly against the inside of the side-walls of mould part 65, so that all clearance between cover-section 72 and the inside of form part 65 is prevented. The strengthened outer edge 67, as well as the reinforcement rib 69, help ensure a correct contact. It should be noted that possible a smaller clearance 20 remains between members 73 and 74, but this is covered by the folded-up weld seam of the extended part 63 of lining 61, so that on a possible pressing action on cover-section 72 and the contents of mould section 65, a uniform pressure on the contents is ensured.

FIGS. 17*a* and 17*b* show alternative embodiments of lid part 72. The gap 80 between elements 73' and 74' is dependent for its direction on the manner of folding the lining 61 in mould 65. Should the welding seam run diagonally then a form of lid corresponding to FIG. 17*a* is advantageous. If the extended part 63 of the lining is folded crossways, then the embodiment of the lid shown in figure 17*b* is preferable.

The cover-members 73, 74, in the various embodiments are in each case mutually connected by curved leaf springs 75, which are welded securely by their end parts at 76 to the cover-members. In this way a freedom of movement of members 73, 73', 74 and 74' in the directions of arrows P1 or P1' is made possible.

FIGS. 18 and 19 show, in perspective, a holder 81, which consists of a framework of longitudinal and transverse profiles, which ensure that guides 82 are made available for a number of adjacently arranged cylindrical mould sections 65. The adjacently situated moulds 65 are so positioned that lid section 72 lies with the spring strips 75 which are mounted thereon against the bottom 66 of the adjacent mould. The filling of the form with meat pieces is such that the spring leaves project beyond the edge 67 of mould 65.

Either the guide 82 or the holder 81 is provided at one end with a fixed end partition 83, against which rests the bottom edge 67 of the first mould. At the opposite end, there is elastically compliant end partition 84 fitted, which here has the form of a ram. The ram lies against the lid section 72 of the mould on the right in FIG. 19, and is elastically supported by a helical spring 85, which travels along a pin 86 of a clamping frame 87. The clamping frame 87 is made with straps 88 which fit around knobs 89 of the frame of the holder 81. The side of the straps 88 and the placing of knobs 89 is such that when clamping frame 87 is fitted on the front of holder 81, the compliant partitions 84 come into spring-loaded contact with the lid sections 72 of the front moulds of each row in a guide 82. By this means, the whole row of moulds is subject to a definite spring pressure, and after closing the entire holder 81 with moulds 65 can be placed in a heating space, for example a steam vessel. Through the supply of heat, the meat expands and becomes pasteurized, whilst the lining 61 shrinks as a result of the heat. Owing to this permanent pressure on the contents of the moulds 65 as the result of springs 85, the contents take on the exact shape of the cylindrical mould section 65, and the lining 61 fits closely around the moulded meat product.

The end product is obtained by removing moulds 65 from the holder, removing cover section 72, and taking out the lining with the shaped meat product in it from the mould.

The invention is not restricted to the above described embodiments.

The embodiments of the invention in which an exclusive property or privilege is claimed are defined as follows:

1. Apparatus for packing a meat product, such as ham in foil, wherein a mould is used to accommodate a bag-shaped foil which has a collar portion located at its open end, characterized by:

a first support member for supporting the bag and the mould, and a first means, displaceable relative to the support member for turning-down the collar of the bag around the top edge of the mould;

a second support member for supporting the mould containing the bag-shaped foil, and a second means, displaceable with respect to the second support member for returning-up the collar of the bag;

a third support member for supporting the mould with the filled bag-shaped foil, equipped with a sealing appliance for sealing the collar.

2. Apparatus according to claim 1, characterized in that the means for turning down and, respectively, for returning the collar, each include at least two blades which are displaceable along the outer wall of the mould.

3. Apparatus according to claim 2, characterized in that the turning-down and the returning blades pivot in a controlled manner on an axis which is transverse to the displacement direction.

4. Apparatus according to claim 2, characterized in that each returning blade is formed as a hook.

5. Apparatus according to claim 4, characterized in that the hook length is equal to at least the collar height of the bag-shaped foil.

6. Apparatus according to claim 2, characterized in that the second support member is a turntable incorporated in a conveyor track and groups of said returning blades are arranged around the turntable.

7. Apparatus according to claim 2, characterized in that the mould is polygonal in cross-section, and that the number of turning-down, and also of returning, blades applied is the same as the number of corners of the mould cross-section.

8. Apparatus according to claim 7, characterized in that the turning-down and the returning means are so arranged, that they operate at the corners of the mould.

9. Apparatus according to claim 1, characterized in that the third support member is formed as a vacuum chest, closable with a door, in which the sealing applicance is accommodated.

10. Apparatus according to claim 9, characterized in that the sealing appliance is formed as a horizontally extending table at the height of the collar of the bag-shaped foil, and a pressing punch which can be moved up and down, a folding element being fitted in the vacuum chest for holding the collar down over the horizontal table.

11. Apparatus according to claim 10, characterized in that the pressing punch is fixed to an airtight hose.

12. Apparatus according to claim 10, characterized in that the folding member is a bent hinge-plate, which can be pivoted, parallel to the pressing table, around a hinge-pin which is fastened to the pressing punch.

13. Apparatus for packing a meat product into a flexible bag which has an open end and a collar portion extending about said open end and wherein a mould which has a mould cavity which is proportioned to accommodate one of said bags in an open position is used, the mould having a top edge extending about an open end thereof, comprising;

(a) a first support member for supporting one of said bags thereon in an open configuration, said first support member also serving to support a mould thereon after a bag has been located therein in a first position such that the collar portion of the bag projects beyond the top edge of the mould, (b) first folding means mounted for movement relative to the support member for folding the collar portion of a bag located in said first position, over said top edge of the mould to turn it down over said top edge to support the bag in a second position with the open end of the bag in an open configuration, (c) second support means for supporting a mould with a bag located therein in said second position, (d) second folding means mounted on said second support means for movement relative thereto, said second folding means including mean to extend over a mould having a bag located therein in said second position to engage the turned down collar portion of the bag and to fold it back to said first position, (e) a third support member for supporting a mould with a bag located therein in said first position, (f) sealing means on said third support for sealing said collar portion of the bag to close the bag.

14. Apparatus as claimed in claim 13, wherein said first support member comprises a first mandrel which is proportioned to provide internal support for a bag and a mould.

15. Apparatus as claimed in claim 14, wherein said first folding means comprises a first support head having a plurality of first folding fingers pivotally mounted thereon and projecting from said support head toward one end of said mandrel, said folding fingers being mounted to pivot between a retracted position in which they are arranged and spaced to fit within an open end of the collar portion of a bag located on said mandrel and an extended position in which the fingers are spaced outwardly from one another so as to be free to telescope into and outwardly overlying relationship with respect to a mould located on said mandrel to fold said collar portion over the top edge of a mould as aforesaid.

16. Apparatus as claimed in claim 15, further comprising a mould having a mould cavity which is proportioned to accommodate one of said bags in an open configuration, said mould having a top edge extending about said mould cavity, said mould having side walls interconnected at corners to form a polygonal cross-section.

17. Apparatus as claimed in claim 16, wherein said first folding means has one first folding finger for each corner of the mould which is aligned therewith in use.

18. Apparatus as claimed in claim 16, wherein said second folding means has one end second folding finger for each corner of the mould, each second folding finger being aligned with a corner of the mould in use.

19. Apparatus as claimed in claim 13, wherein said second folding means comprises a second support head which is mounted to reciprocate with respect to said second support means between a first retracted position and a second extended position, said second support head having a plurality of second folding fingers pivotally mounted thereon and projecting from said second support head toward said second support means, said second folding fingers being pivotal between a first position in which they are spaced outwardly from one another so as to be free to telescope into and outwardly overlying relationship with respect to a mould located on said second support with a bag located therein in its second position, and a second position in which said folding fingers are located closely adjacent said mould so as to engage the collar portion of the bag to fold it back to its first position as aforesaid when said support head reciprocates from its extended position to its retracted position.

20. Apparatus as claimed in claim 19, wherein each of said second folding fingers has a distal end remote from said second support head, said distal end of each second folding finger being hook-shaped to hook under the marginal edge of a bag located in said second position on a mould to facilitate folding of the marginal edge in response to the reciprocating movement of said second folding head.

21. Apparatus as claimed in claim 13, wherein said second support means comprises a turntable mounted for rotation about a first axis and said second folding means comprises a plurality of second folding assemblies each located at spaced intervals about said turntable and mounted for rotation about said first axis and infeed conveyor means for feeding said moulds one at a time onto said turntable to locate the moulds with their open ends aligned one with said second folding assemblies and a mould discharge conveyor for receiving and transporting moulds away from said turntable.

22. Apparatus as claimed in claim 13, wherein said third support member further comprises a vacuum chest in which said sealing means is mounted.

23. Apparatus as claimed in claim 13, wherein said sealing means further comprises a sealing table which is spaced above said second support means at a height corresponding to the height of the collar of the bag when the bag is located in its first position, sealing press means mounted above said sealing table for movement toward and away from said sealing table to cooperate therewith to clamp and seal the collar portion of a bag therebetween and collar folding means for folding the collar of a bag into a position extending between the sealing table and the sealing press means.

24. Apparatus as claimed in claim 23, wherein said sealing press means comprises a sealing head mounted on an expandible air-tight hose which serves to locate the sealing head in a retracted position with respect to the sealing table when deflated and an extended position with respect to the table when inflated.

25. Apparatus as claimed in claim 24, wherein the collar folding means comprises a plate which is generally L-shaped and which is pivotally mounted above the sealing table for movement between a first position spaced from the sealing table and a second position extending the sealing table and the sealing head.

26. Apparatus as claimed in claim 13, further comprising a cylindrical mould having a mould cavity, a bottom wall closing the mould cavity and an open end providing access to the mould cavity and a cover plate proportioned to fit in a close fitting relationship within said open end of said mould.

27. Apparatus as claimed in claim 26, wherein said cover plate comprises a plurality of sections which are movable with respect to one another between a retracted position in which the perimeter of the cover plate is reduced in length and an extended position in which the perimeter of the cover plate is extended in length so as to fit in a close fitting relationship within the mould as aforesaid.

28. Apparatus as claimed in claim 27, wherein the sections of the cover plate are mutually connected by spring means which serves to normally urge the cover plate to the extended position.

29. Apparatus as claimed in claim 28, wherein the mould cavity is rectangular in cross-section and has side walls which are formed with one or more reinforcing ridges.

30. Apparatus as claimed in claim 29, wherein the open end of the mould is reinforced.

* * * * *